US011081766B1

(12) United States Patent
Wrigley

(10) Patent No.: US 11,081,766 B1
(45) Date of Patent: Aug. 3, 2021

(54) MODE-WHISPERER LINEAR WAVEGUIDE OMT

(71) Applicant: LOCKHEED MARTIN CORPORATION, Bethesda, MD (US)

(72) Inventor: Jason Stewart Wrigley, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 127 days.

(21) Appl. No.: 16/584,745

(22) Filed: Sep. 26, 2019

(51) Int. Cl.

| | |
|---|---|
| ***H01P 1/161*** | (2006.01) |
| ***H01Q 13/02*** | (2006.01) |
| ***H01P 1/213*** | (2006.01) |
| ***H01Q 15/24*** | (2006.01) |
| ***H01Q 21/24*** | (2006.01) |

(52) U.S. Cl.
CPC ..... *H01P 1/161* (2013.01); *H01P 1/2131* (2013.01); *H01Q 13/0258* (2013.01); *H01Q 15/242* (2013.01); *H01Q 21/24* (2013.01)

(58) Field of Classification Search
CPC .. H01P 1/16; H01P 1/161; H01P 1/213; H01P 1/2131; H01Q 13/0258; H01Q 15/242; H01Q 15/244; H01Q 21/24; H01Q 21/245
USPC ..... 333/126
See application file for complete search history.

(56) References Cited

U.S. PATENT DOCUMENTS

| | | | | |
|---|---|---|---|---|
| 7,432,780 | B2 * | 10/2008 | Chan | H01P 1/161 333/127 |
| 8,049,674 | B2 * | 11/2011 | Tzelepis | H01Q 25/04 343/786 |
| 9,297,893 | B2 * | 3/2016 | Granet | H01Q 13/0208 |
| 10,381,699 | B2 * | 8/2019 | Fraysse | H01P 1/161 |
| 2016/0049733 | A1 * | 2/2016 | Dunning | H01Q 13/0258 343/756 |
| 2020/0266510 | A1 * | 8/2020 | Menargues Gomez | H01P 1/161 |

* cited by examiner

*Primary Examiner* — Robert J Pascal
*Assistant Examiner* — Kimberly E Glenn
(74) *Attorney, Agent, or Firm* — Morgan, Lewis & Bockius LLP

(57) ABSTRACT

The mode-whisperer waveguide device includes a main waveguide, a junction waveguide and a pair of recombination arm waveguides. The main waveguide features a spline taper extending along an axis of the main waveguide. The spline taper has been integrated with the normal linear aperture taper. The junction waveguide is attached to the main waveguide. The recombination arm waveguides are attached to the junction waveguide. A first port is coupled to the pair of recombination arm waveguides via a pair of recombination arm transformer steps. The main waveguide, the junction waveguide, the pair of recombination arm waveguides and the pair of recombination arm transformer steps are manufacturable as a monolithic waveguide device that is configured to achieve outstanding higher-order mode suppression due to the gradual dual spline taper which has been integrated with the normal linear taper to the aperture port.

20 Claims, 10 Drawing Sheets

MODE-WHISPERER LINEAR WAVEGUIDE OMT

STATEMENT REGARDING FEDERALLY SPONSORED RESEARCH OR DEVELOPMENT

Not applicable.

FIELD OF THE INVENTION

The present invention generally relates to satellite communication and, more particularly, to a linear waveguide orthomode transducer (OMT), the mode whisperer.

BACKGROUND

Orthomode transducer (OMT) devices are often used in very small aperture terminals (VSATs) and terrestrial microwave radio feeds with feed horns as a polarization duplexer. An OMT device is a waveguide component that serves either to combine or to separate two orthogonally polarized microwave signals.

SUMMARY

According to various aspects of the subject technology, methods and configuration for the mode-whisperer linear OMT device are disclosed. The OMT device of the subject disclosure can separate and/or combine vertical polarization (VPOL) from horizontal polarization (HPOL) modes in waveguides of a communications system for reception and/or transmission purposes.

In one or more aspects, the mode-whisperer waveguide device includes a main waveguide, a junction waveguide and a pair of recombination arm waveguides. The main waveguide features a spline taper, which has been integrated with the normal linear aperture taper to either square or circular waveguide extending along an axis of the main waveguide. The junction waveguide is attached to the main waveguide. The recombination arm waveguides are attached to the junction waveguide. A first port is coupled to the pair of recombination arm waveguides via a pair of recombination arm transformer steps. The main waveguide, the junction waveguide, the pair of recombination arm waveguides and the pair of recombination arm transformer steps are manufacturable as a monolithic waveguide device that can achieve outstanding higher-order mode suppression due to the gradual dual spline taper which has been integrated with the normal linear taper to the aperture port In other aspects, an OMT device includes a main waveguide, a junction waveguide and a pair of recombination arm waveguides. The main waveguide has an H-shaped first aperture that transitions to a second aperture through a spline taper extending along an axis of the main waveguide. The junction waveguide is attached to the H-shaped first aperture of the main waveguide. The recombination arm waveguides are attached to the junction waveguide. A first port of the OMT device is coupled to the recombination arm waveguides via a pair of recombination arm transformer steps. The OMT device is fabricated as a monolithic waveguide device and is configured to achieve outstanding higher-order mode suppression due to the gradual dual spline taper which has been integrated with the normal linear taper to the aperture port In yet other aspects, a satellite communication system includes a satellite antenna and a polarization duplexer coupled to the satellite antenna. The polarization duplexer consists of the monolithic mode-whisperer including a main waveguide, a junction waveguide and a pair of recombination arm waveguides. The main waveguide has a spline taper extending along an axis of the main waveguide. The junction waveguide is attached to a first aperture of the main waveguide. The recombination arm waveguides are attached to the junction waveguide, and a first port is coupled to the recombination arm waveguides via a pair of recombination arm transformer steps. The monolithic mode-whisperer is a linear waveguide OMT device that can suppress modes launched due to asymmetries.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure and the advantages thereof, reference is now made to the following descriptions to be taken in conjunction with the accompanying drawings describing specific aspects of the disclosure, wherein.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

In some aspects of the present technology, methods and configuration for the mode-whisperer linear waveguide orthomode transducer (OMT) device are disclosed. The OMT device of the subject disclosure can separate and/or combine vertical polarization (VPOL) from horizontal polarization (HPOL) modes in waveguides of a communications system for reception and/or transmission purposes. The subject technology leverages a hybrid spline taper that is based on a hybrid spline taper consisting of a rectangular-to-circular linear taper and a double-sided spline taper. Because of the lack of modes launched by the disclosed hybrid spline taper, the subject solution can use a purely reactive combiner network that drastically reduces the footprint for fitting behind small apertures. One existing solution uses a thin-septum OMT that consists of tuned trombones and a loaded magic tee along with a thin-septum OMT junction.

The subject technology has a number of advantageous features over some existing solutions. Examples of these advantageous features include greater than two-time reduction in cost, schedule acceleration by an order of magnitude, availability of parts from a single vendor, no iterative tuning requirement, reduction in mass by over a half order of magnitude, complexity reduction by about 80%, consisting of only one part rather than five and increased passive intermodulation product (PIM) and multipaction performance. Further, the disclosed technology includes one continuous internal copper surface with a hybrid spline taper that suppresses modes sufficiently even with mismatched recombination arm lengths with more than five times manufacturing tolerances. The OMT device of the subject technology can be designed to be fabricated as a single-mandrel electroform with no internal mating features and with a continuous internal copper surface. The disclosed solution appears to be the best PIM solution that includes robust features with minimal matching requirements.

Figure 1:
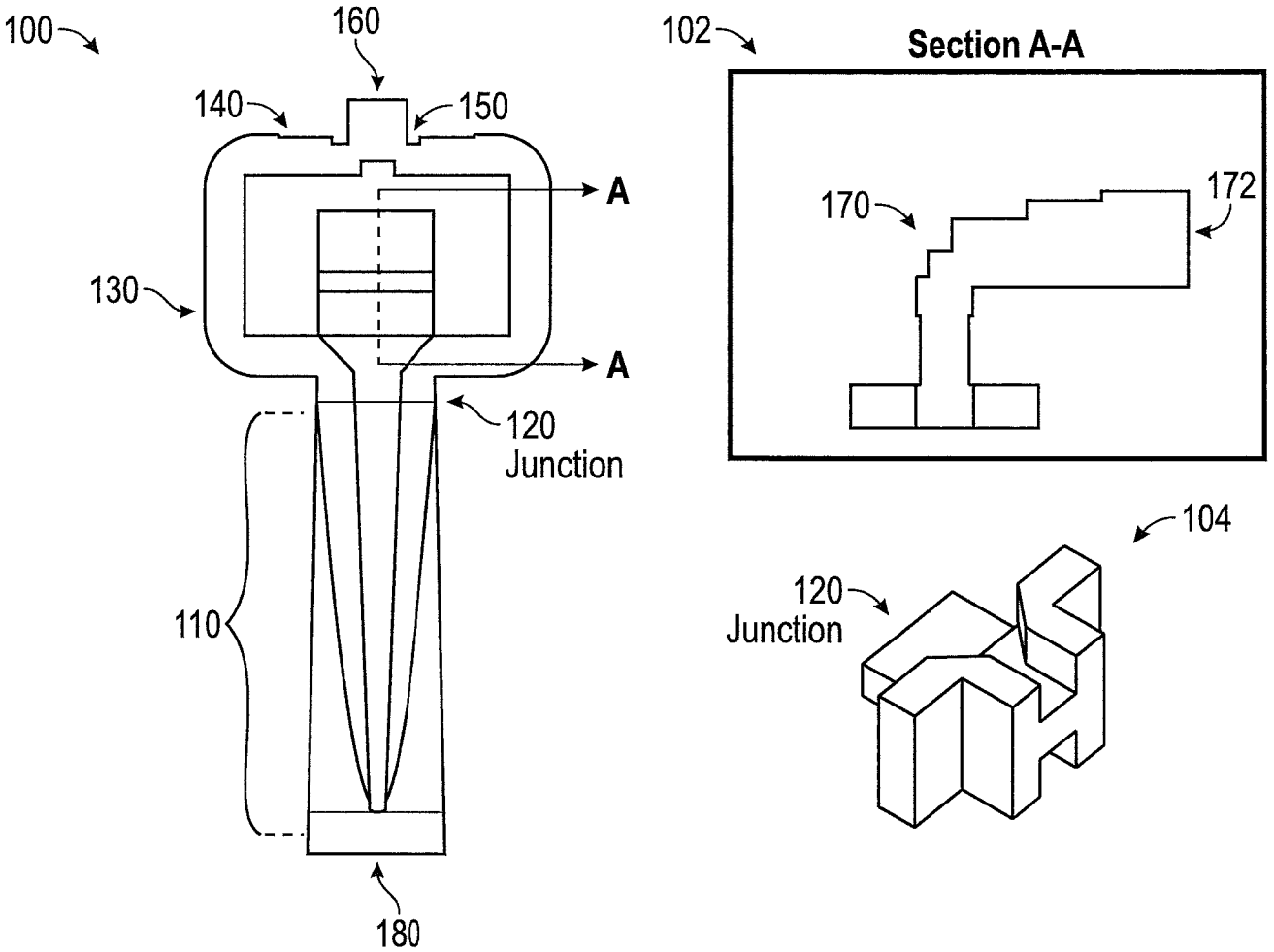
FIG. 1 is a schematic diagram illustrating an example of a mode-whisperer waveguide device, according to certain aspects of the disclosure.

FIG. 1 is a schematic diagram illustrating an example of the mode-whisperer waveguide device 100, according to certain aspects of the disclosure. The mode-whisperer waveguide device 100 is a linear waveguide orthomode transducer (OMT) device that can be manufactured as a monolithic device and is able to achieve outstanding higher order mode suppression due to the symmetric dual spline ridge which has been integrated with the normal linear taper to the aperture, as explained in more detail herein. The mode-whisperer waveguide device 100 (also referred to as an OMT device or a polarization duplexer) can be coupled to an antenna to mix or separate two orthogonally polarized signals. The mode-whisperer waveguide device 100 includes a main waveguide 110, a junction waveguide 120, a pair of recombination arm waveguides 130, a pair of recombination arm transformer steps 140, and a port a reactive waveguide splitter and/or combiner 150 and a first port 160.

The main waveguide 110 includes a hybrid spline with a taper extending along the axis of the main waveguide, this hybrid spline taper has been combined with the normal linear aperture taper. The hybrid spline with the taper provides a transition from rectangular ridge waveguide to either a rectangular or circular waveguide aperture. The main waveguide 110 has a H-shaped cross-section at the first aperture joining the junction 120 that supports vertical polarization (VPOL) and horizontal polarization (HPOL). The main waveguide 110 can have a circular cross-section or rectangular (e.g., square) cross-section at a second aperture 180, which is the input for of the mode-whisperer waveguide device 100. The junction waveguide 120, as shown in a perspective view 104, has an H-shaped cross-section aperture that matches the H-shaped cross-section of the first aperture of the main waveguide 110, at which the junction waveguide 120 and the main waveguide 110 join each other. The junction waveguide 120 has three output ports with rectangular apertures. The first output port is coupled to a VPOL port through a stepped 90° transformer bend and the other two HPOL ports are coupled to the pair of recombination arm waveguides 130. The two ports coupled to the pair of recombination arm waveguides 130 are at about 90° with respect to the first output port. The stepped 90° transformer bend is a dual-purpose stepped E-plane bend that incorporates one section of a step transformer. By using steps rather than chamfers for the 90° bend, we enable mandrel fabrication via direct machining, eliminate sinker EDM operations and climb milling.

The pair of recombination arm waveguides 130 are near featureless and planar, which enables best-possible manufacturing tolerances via wire electrical-discharge machining (Wire EDM). The pair of recombination arm transformer steps 140 provide bending for the pair of recombination arm waveguides 130 to join the reactive waveguide splitter and/or combiner 150 that couples the pair of recombination arm waveguides 130 to first port 160. The first port 160 is the HPOL port of the mode-whisperer waveguide device 100. As mentioned before, the geometry of mode-whisperer waveguide device 100 readily lends itself to electroforming and is robust while not launching higher-order modes, even in the presence of extreme manufacturing tolerances such as recombination arm mismatch.

Figure 2:
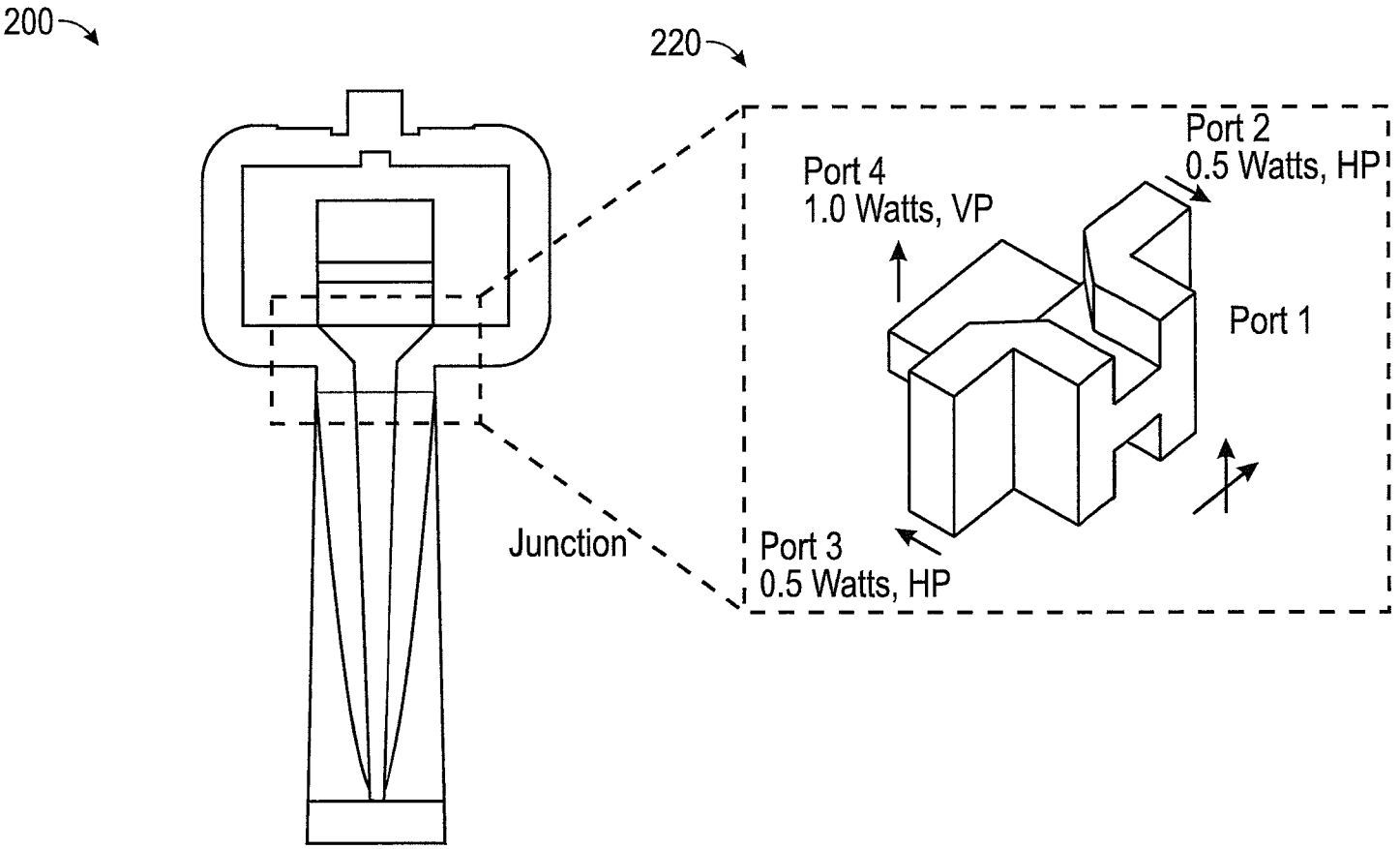
FIG. 2 is a schematic diagram illustrating an example of a junction waveguide of the mode-whisperer waveguide device, according to certain aspects of the disclosure.

FIG. 2 is a schematic diagram illustrating an example of a junction waveguide 220 of the mode-whisperer waveguide device 200, according to certain aspects of the disclosure. The mode-whisperer waveguide device 200 is similar to the mode-whisperer waveguide device 100 of FIG. 1, and is shown herein to indicate more details on the junction waveguide 220. The junction waveguide 220 has an input port (port 1) that has a H-shaped aperture and supports two orthogonal polarizations, such as VPOL and HPOL. The other two ports, port 2 and 3 have rectangular apertures and can transmit HPOL signals. The forth port (port 4) also has a rectangular aperture and can transmit VPOL signals to the pair of recombination arm waveguides 130 of FIG. 1. For example in FIG. 2, a 2 Watts signal with mixed polarization entering port 1 can be divided into two 0.5 Watts HPOL signals at ports 2 and 3, and a 1 Watts VPOL signal at port 4.

Figure 3:
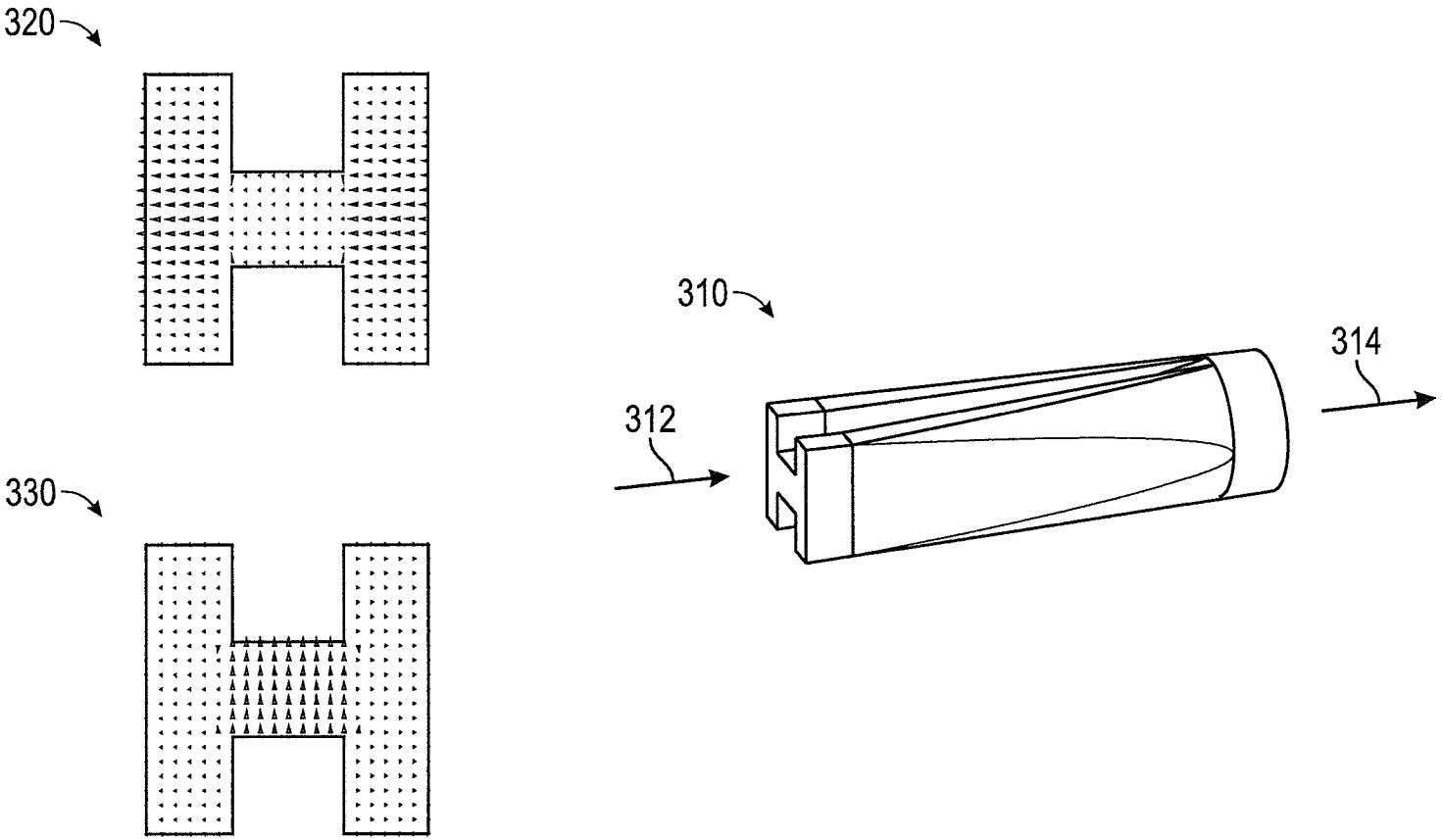
FIG. 3 is a schematic diagram illustrating an example of a main waveguide of the mode-whisperer waveguide device along with corresponding polarization modes, according to certain aspects of the disclosure.

FIG. 3 is a schematic diagram illustrating an example of a main waveguide 310 of the mode-whisperer waveguide device (e.g., 100 of FIG. 1) along with corresponding polarization mode plots 320 and 330, according to certain aspects of the disclosure. The main waveguide 310, as explained above, has a hybrid spline taper that enables transition from the H-shaped cross-section at an aperture 312, that can be joined to the junction waveguide 120 of FIG. 1, to the circular cross-section the input port 314. An objective of the mode-whisperer waveguide device of the subject technology including the waveguide 310, is to transmit the two modes to the aperture 312 while keeping all the other higher order modes suppressed below about 40 dB.

The first desired mode is a transverse-electric (TE) 01 HPOL, as shown in mode plots 320; and the second desired mode is TE10 VPOL, as shown in mode plots 330. The TE01 and TE10 modes are the first two modes that are used to carry the communicated information. If other modes exist (e.g., are launched by the taper) in excess of about 40 dB, the commination channel becomes jeopardized. The hybrid spline taper of the subject technology, which is combined with the normally linear aperture taper, reduces part length while greatly suppressing these higher order modes. The mode received at the input port 314 are TE11 VPOL and TE11 HPOL.

Figure 4:
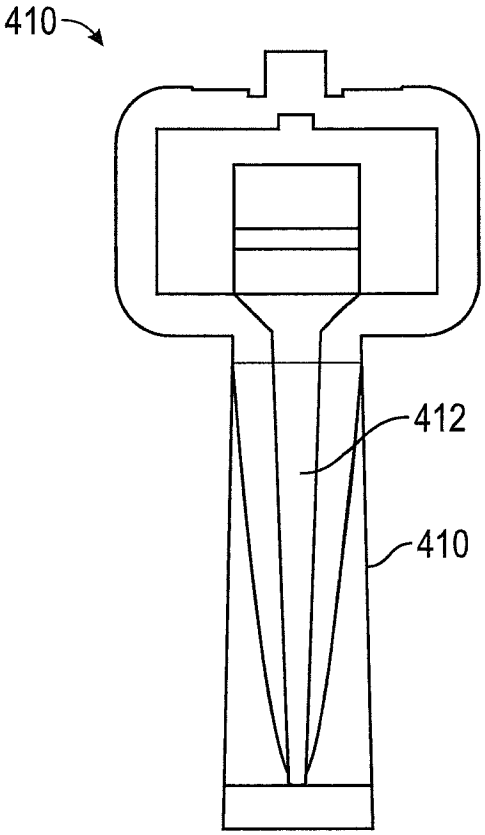
FIG. 4 is a schematic diagram illustrating views of an example of the mode-whisperer waveguide device with a rectangular input port, according to certain aspects of the disclosure.
Figure 4:
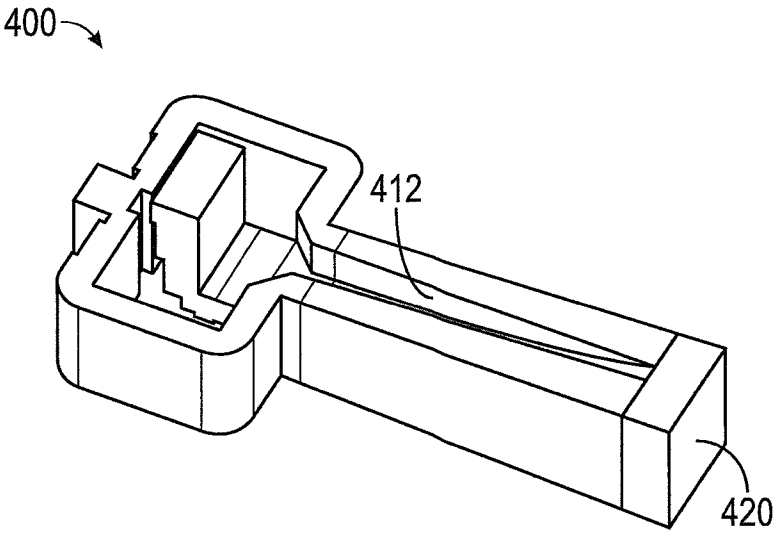

FIG. 4 is a schematic diagram illustrating views of an example of the mode-whisperer waveguide device 400 with rectangular input port 420, according to certain aspects of the disclosure. The mode-whisperer waveguide device 400 is structurally similar to the mode-whisperer waveguide device 100 of FIG. 1, except that the input port 420 has a rectangular cross-section rather than the circular cross-section as in FIG. 1. The top view 410 of the mode-whisperer waveguide device 400 shows the mode suppression taper 412 of the main waveguide 410.

Figure 5:
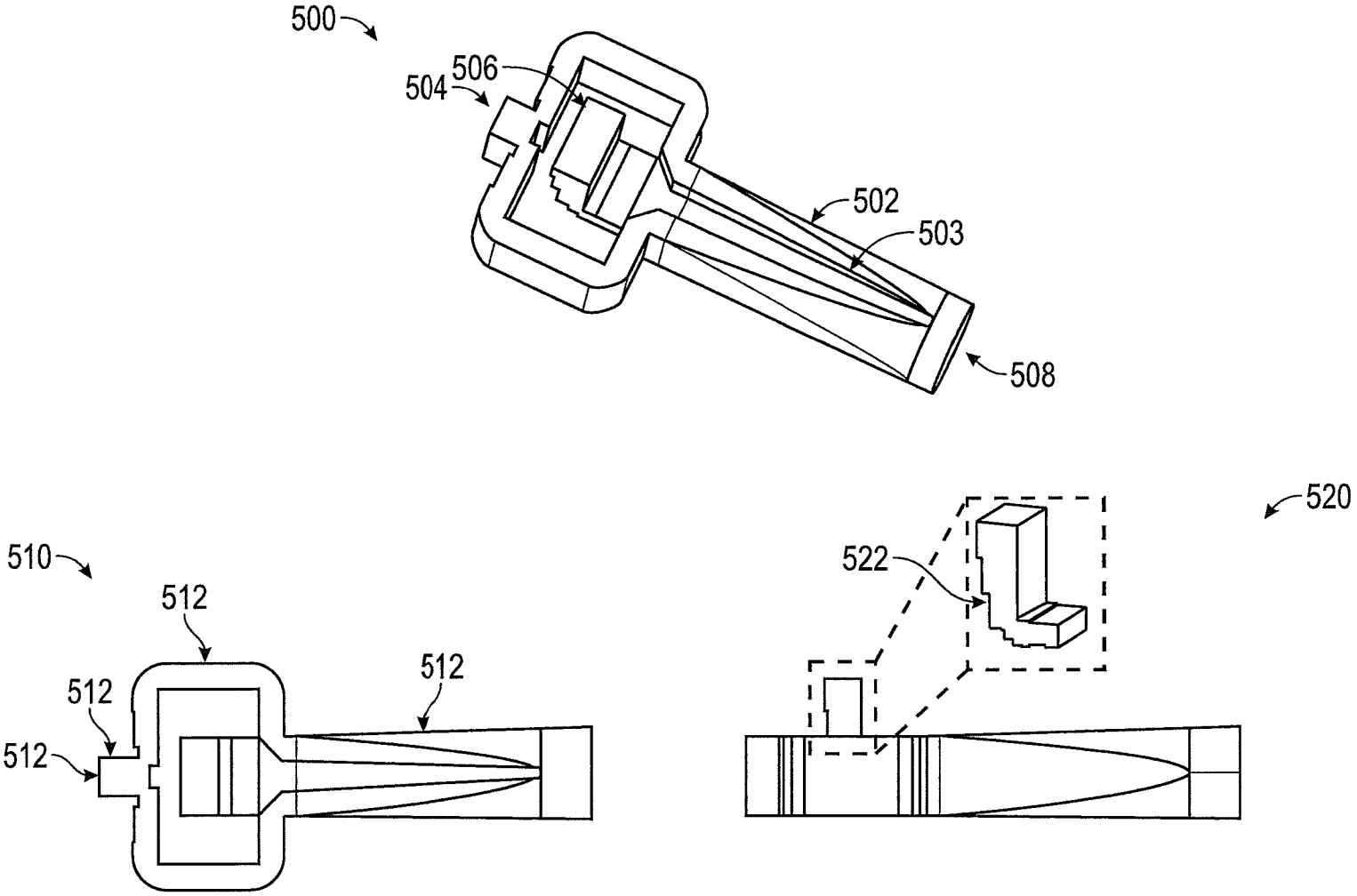
FIG. 5 is a schematic diagram illustrating views of an example of the mode-whisperer waveguide device with a circular input port, according to certain aspects of the disclosure.

FIG. 5 is a schematic diagram illustrating views 500, 510 and 520 of an example of the mode-whisperer waveguide device (e.g., 100 of FIG. 1) with circular input port, according to certain aspects of the disclosure. In the view 500 of mode-whisperer waveguide device of the subject technology, the numeral 502 refers to the compact hybrid spline mode suppression taper of the subject technology. The numeral 503 shows a robust symmetric spline ridge on top and bottom only. The input port 508 is antenna port that can have a diameter of about 0.880 inch. The ports 504 and 506 are HPOL and VPOL ports.

In the view 510, the numeral 512 refers to the pair of recombination arm waveguides 130, the pair of recombination arm transformer steps 140 and the reactive waveguide splitter and/or combiner 150 of FIG. 1 that are nearly feature-free and have planar structure that enable wire EDM in a single pass, which absolutely minimizes manufacturing tolerances. By outputting a standard waveguide size, these parts greatly reduce part length and minimizes complexity.

In the view 520, the bend waveguide 522 is shown that is dual-purpose stepped E-plane bend that only incorporates one section of a step transformer, which enables profile reduction. Additionally, the bend waveguide 522 has been designed in a manner that permits direct machining with no undercuts thereby permitting fabrication as a seamless mandrel with no sinker EDM operations.

Figure 6:
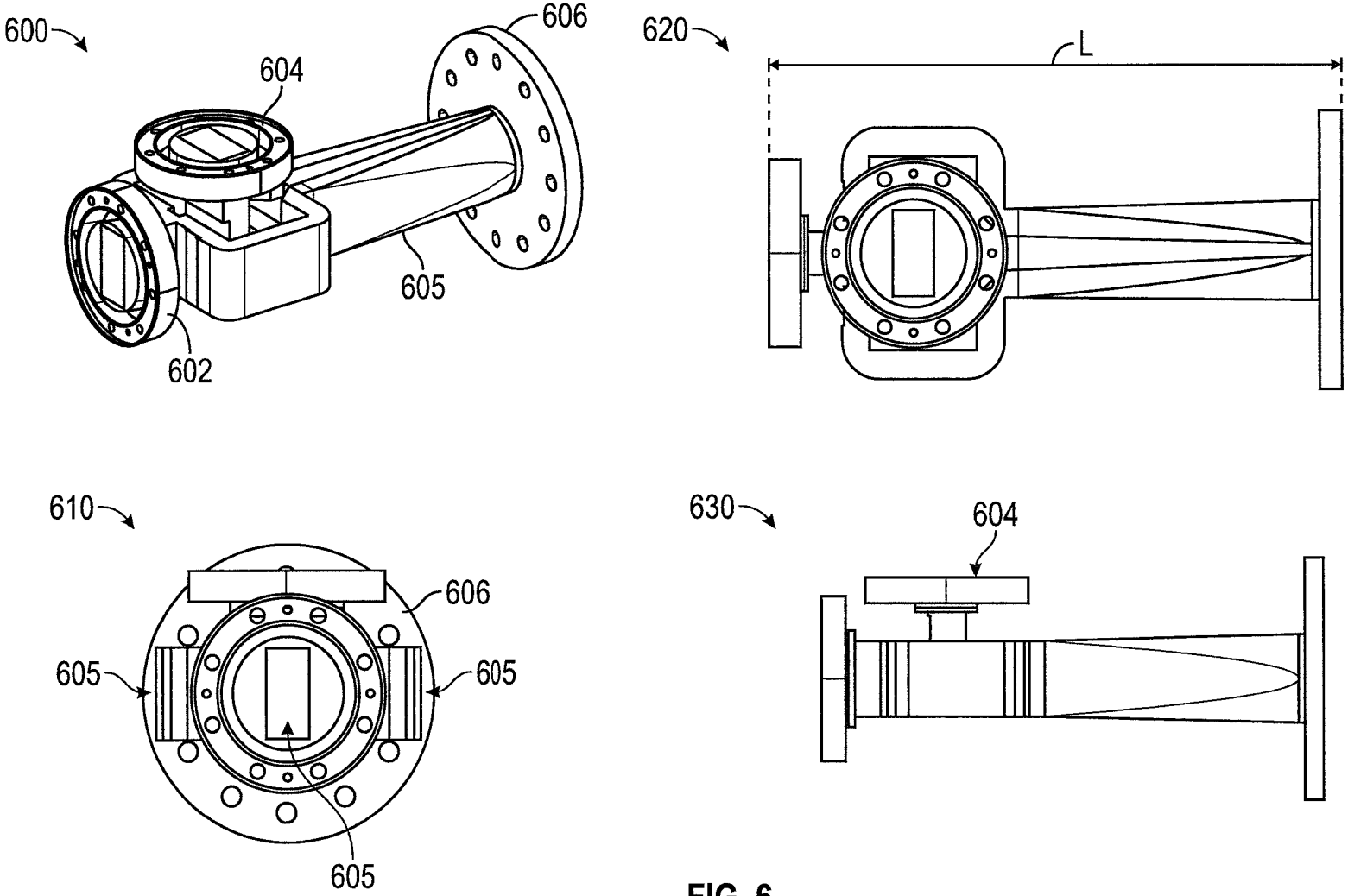
FIG. 6 is a schematic diagram illustrating views of an example of the mode-whisperer waveguide device coupled to flanges, according to certain aspects of the disclosure.

FIG. 6 is a schematic diagram illustrating views 600, 610, 620 and 630 of an example of an assembly of the mode-whisperer waveguide device 605 coupled to flanges 602, 604 and 606, according to certain aspects of the disclosure. The assembly shown in the view 600 depicts the mode-whisperer waveguide device 605 coupled to choke flanges 602 and 604, and a heritage horn flange 606, which is used to connect a horn antenna. As shown in the view 610, which is a view from the flange 602, the mode-whisperer waveguide device 605 is desirably eclipsed by the heritage horn flange 606. The view 620 is a side view that indicates the length L of the assembly to be about 5 inches for Ku band frequencies. The flange 604, shown in the side view 630 is a choke flange that can be coupled to an E-bend to make the port rear facing. The assembly shown in FIG. 6 has a compact profile and fits behind the smallest apertures, with an insertion loss of less than about 0.04 dB along with a significant reduction in mass compared to the existing solutions.

Figure 7:
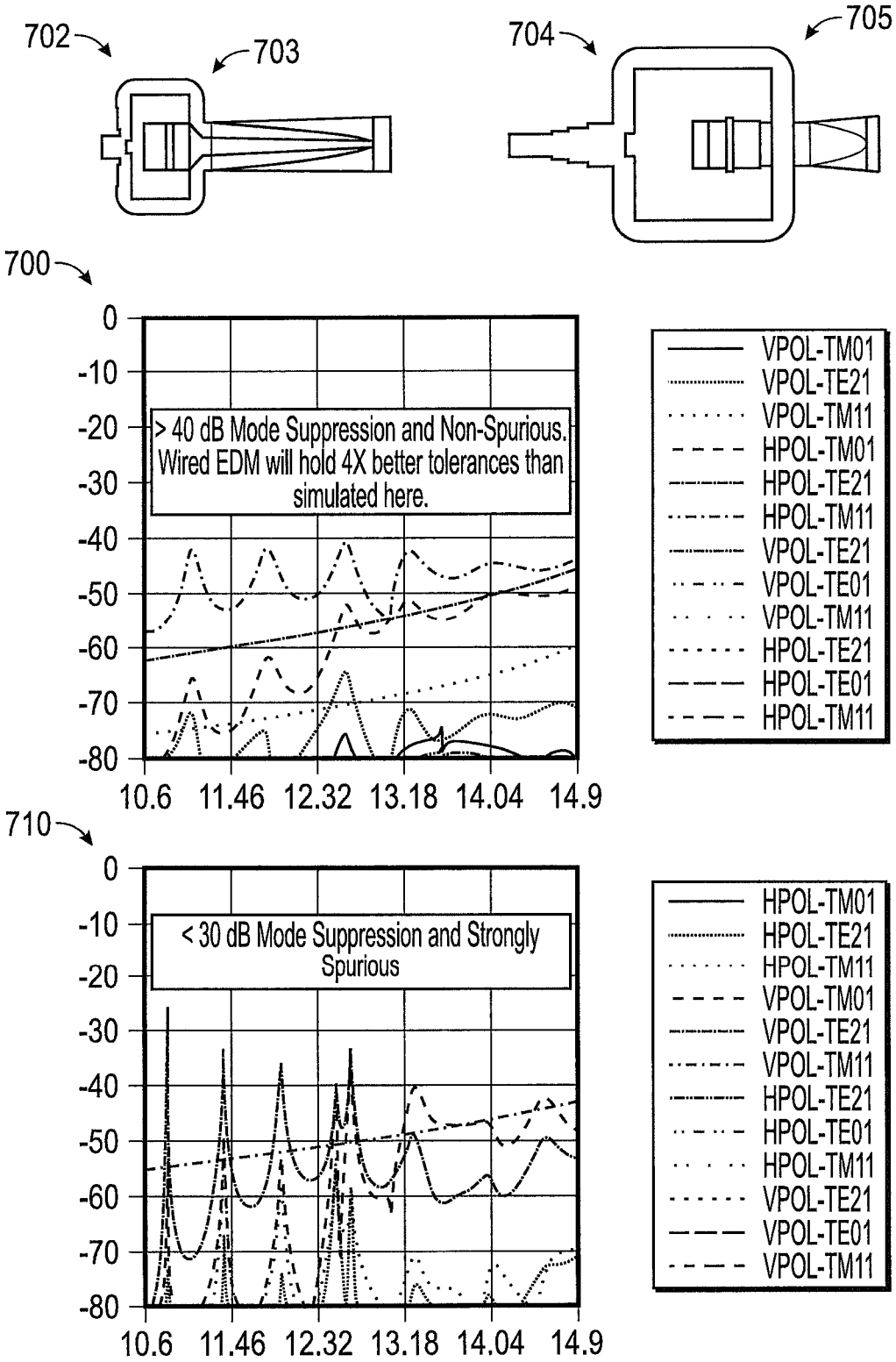
FIG. 7 illustrates charts showing plots of simulated mode content for an unbalanced OMT device of the subject technology and an existing OMT device.

FIG. 7 illustrates charts showing plots 700 and 710 of simulated mode content for an unbalanced OMT device 702 of the subject technology and an existing OMT device 704 (e.g., a thin-septum OMT driven with a purely reactive combiner) over the full Ku Band or 10.7 to 14.8 GHz. The imbalance in the OMT devices 702 and 704 are in the recombination arms 703 and 705, which are unbalanced by about 0.002 inches. The plot 700 shows that, for the unbalanced OMT device 702 of the subject technology, the higher order mode (other than the desired TE01 HPOL and TE10 VPOL) suppression is more than 40 dB and the spectra are nonspurious. It is noted that wire EDM can hold four times better tolerance than used in the simulation. The plot 710 shows that, for the unbalanced existing OMT device 702, the higher mode suppression is less than 25 dB and the spectra are strongly spurious.

Figure 8:
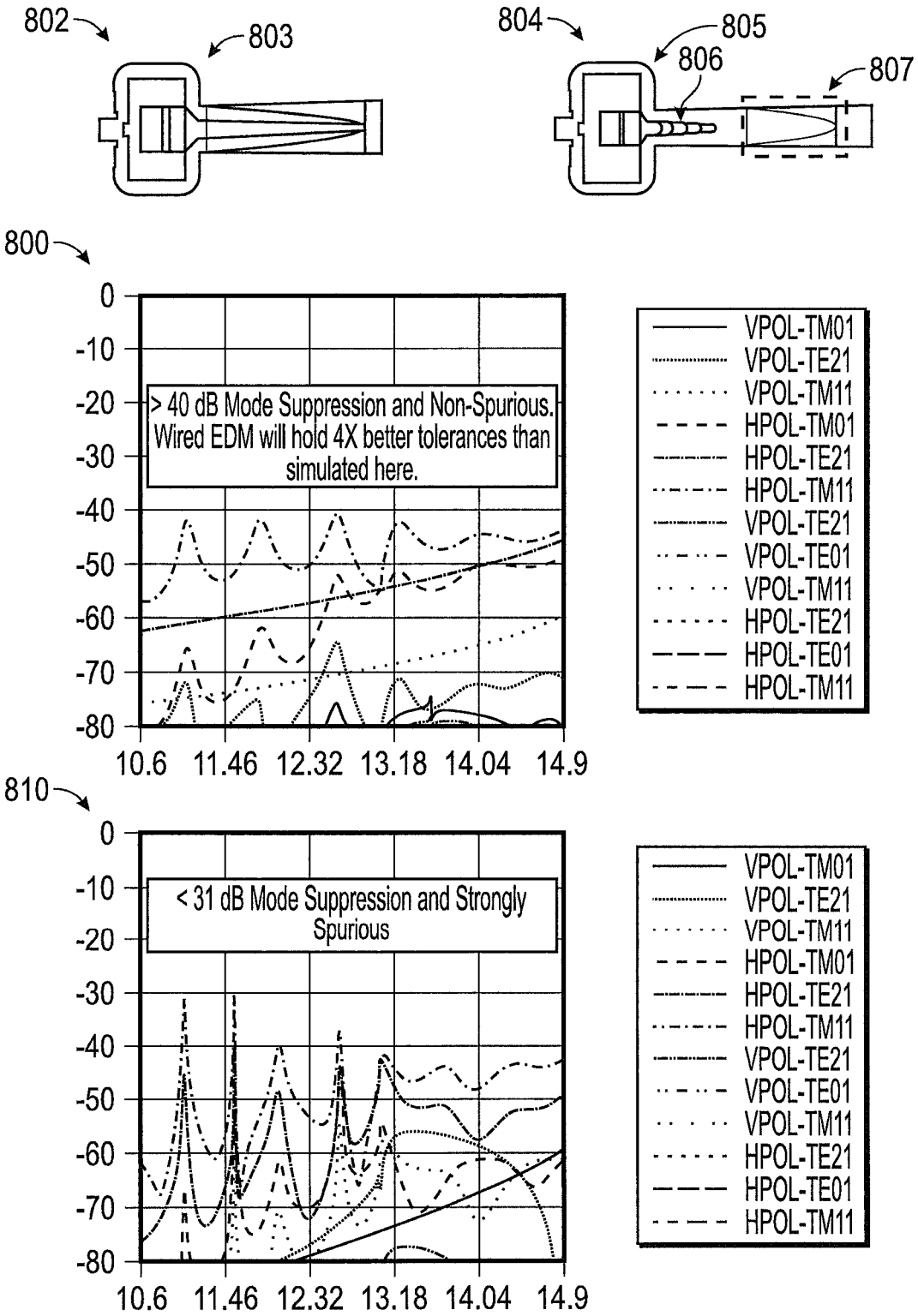
FIG. 8 illustrates charts showing plots of simulated mode content for an unbalanced OMT device of the subject technology and an existing OMT device.

FIG. 8 illustrates charts showing plots 800 and 810 of simulated mode content for an unbalanced OMT device 802 of the subject technology and an existing OMT device 804 (e.g., a Boifort OMT device) over the full Ku Band or 10.7 to 14.8 GHz. The imbalance in the OMT devices 802 and 804 are in the recombination arms 803 and 805, which are unbalanced by about 0.002 inches. The plot 800 shows that, for the unbalanced OMT device 802 of the subject technology, the higher mode (other than the desired TE01 HPOL and TE10 VPOL) suppression is more than 40 dB and the spectra are nonspurious. It is noted that wired EDM can hold four times better tolerance than used in the simulation.
The unbalanced OMT device 804 is shown to have a stepped ridge transition 806 and a normal linear aperture taper 807, which can also be applied to a square waveguide. The plot 810 shows that, for the unbalanced existing OMT device 804, the higher mode suppression is less than 31 dB and the spectra are strongly spurious. The imbalance in the OMT devices 802 and 804 are in the recombination arms 803 and 805, which are unbalanced by about 0.002 inches. The plot 800 shows that, for the unbalanced OMT device 802 of the subject technology, the higher mode (other than the desired TE01 HPOL and TE10 VPOL) suppression is more than 40 dB and the spectra are nonspurious. It is noted that wired EDM can hold four times better tolerance than used in the simulation. The plot 810 shows that, for the unbalanced existing OMT device 802, the higher mode suppression is less than 31 dB and the spectra are strongly spurious.

Figure 9:
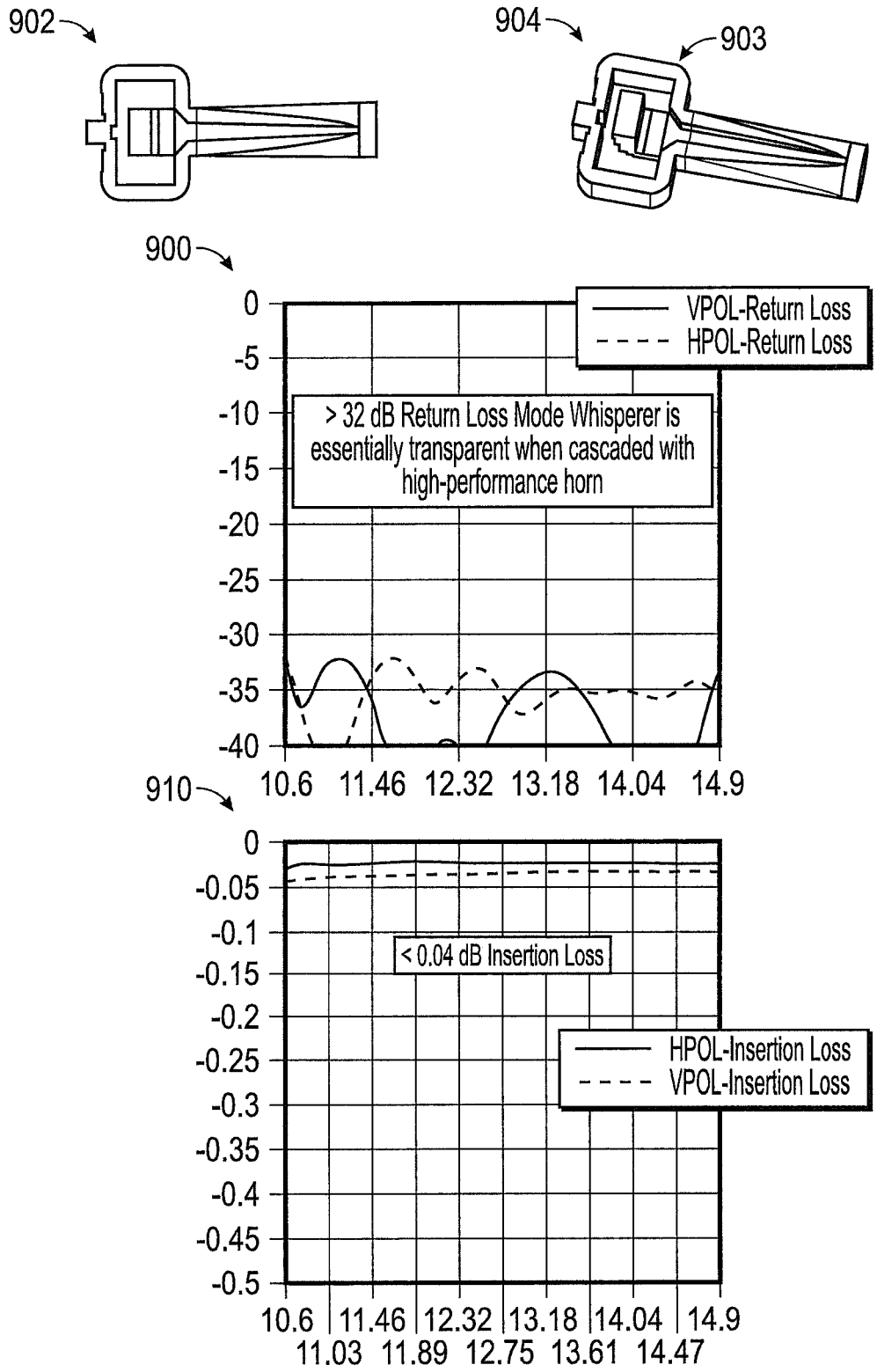
FIG. 9 illustrates charts showing plots of simulated return loss and insertion loss for an unbalanced OMT device of the subject technology.

FIG. 9 illustrates charts showing plots of simulated return loss and insertion loss for an unbalanced OMT device of the subject technology over the full Ku operating band of 10.7 to 14.8 GHz. The plot 900 shows that, for the unbalanced OMT device 902 of the subject technology, the return loss is less than 32 dB and the mode-whisperer is nearly transparent when cascaded with a high-performance horn antenna. The imbalance in the OMT devices 904 is in the recombination arms 903 that are unbalanced by about 0.002 inches. The chart 910 shows the insertion loss for the unbalanced OMT device 904. The plot 910 shows that the insertion loss for both HPOL and VPOL modes are less than about 0.04 dB.

Figure 10:
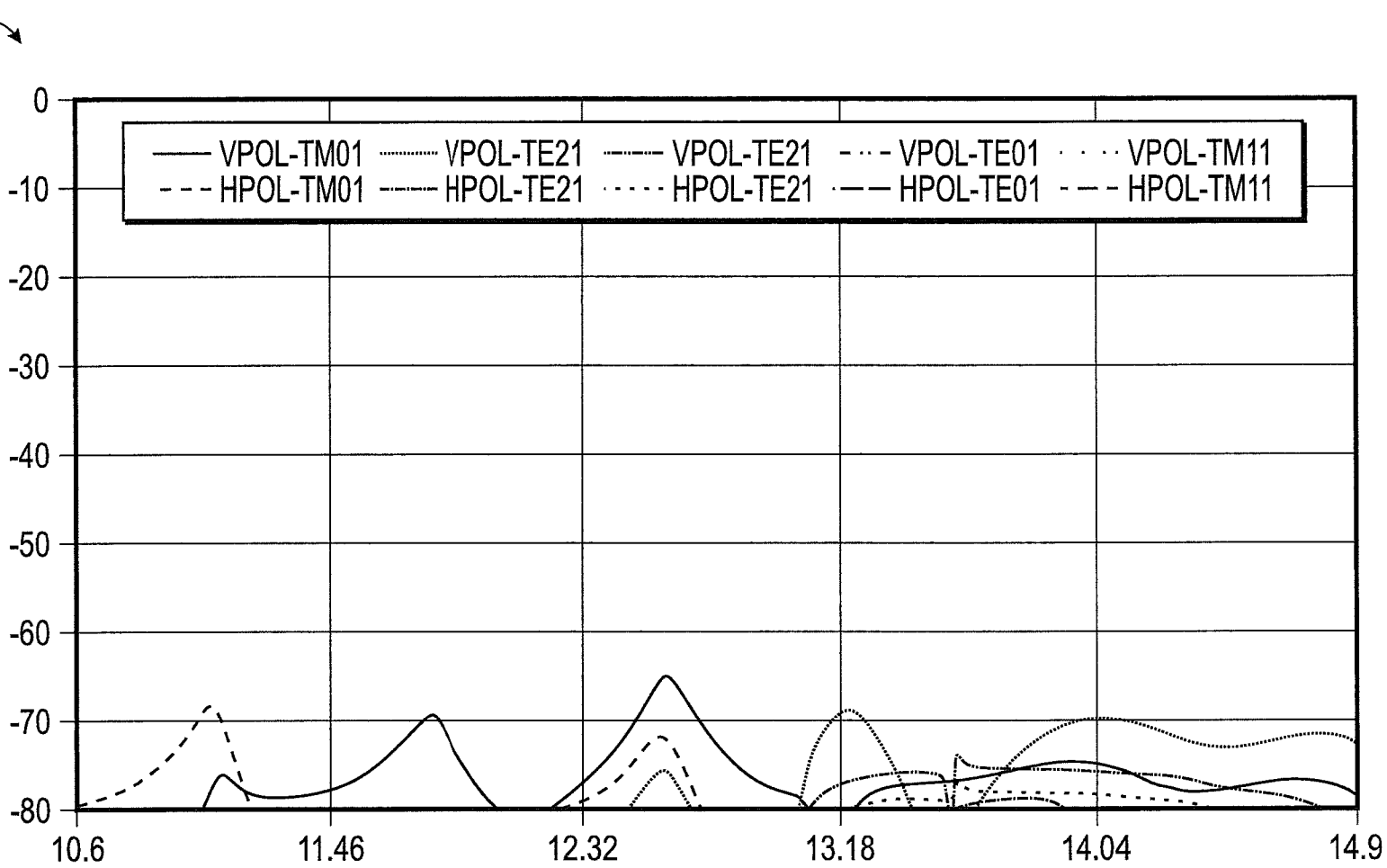
FIG. 10 illustrates a chart showing plots of mode content under nominal conditions for the OMT device of the subject technology.

FIG. 10 illustrates a chart 1000 showing plots of mode content under nominal conditions for the OMT device of the subject technology. The plots shown in FIG. 10 depict various modes such as VPOL-TM01, VPOL-TE21, VPOL-TE01, VPOL-TM11, HPOL-TM01, HPOL-TE21, HPOL-TE01 and HPOL-TM11. It is interesting to note that for all these modes, the nominal balanced mode content suppression of the mode whisper OMT of the subject technology is more than about 65 dB and nonspurious.

In summary, the mode-whisperer of the subject technology provides a number of benefits over some existing approaches. For example, greater than three-times cost reduction, schedule acceleration by multiple orders of magnitude, convenience of availability of parts from one vendor, mass reduction by over a half order of magnitude, about 80% complexity reduction. Furthermore, the mode-whisperer of the subject technology can be produced with an increased PIM and multipaction performance, for example, with one continuous internal copper surface created from a single mandrel. Additionally, the attractive skinny front-end envelope fits readily behind smallest apertures, and the hybrid spline taper suppresses modes sufficiently, even with mismatched recombination arm lengths in excess of five times the manufacturing tolerances.

Those of skill in the art would appreciate that the various illustrative blocks, modules, elements, components, methods and algorithms described herein may be implemented as electronic hardware, computer software or combinations of both. To illustrate this interchangeability of hardware and software, various illustrative blocks, modules, elements, components, methods and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public, regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined or modified, and all such variations are considered within the scope and spirit of the present invention. While compositions and methods are described in terms of "comprising," "containing" or "including" various components or steps, the compositions and methods can also "consist essentially of," or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. A mode-whisperer waveguide device, the device comprising:

a main waveguide with a spline taper that is combined with a linear aperture taper, extending along an axis of the main waveguide;

a junction waveguide attached to a first aperture of the main waveguide;

a pair of recombination arm waveguides attached to the junction waveguide; and a first port coupled to the pair of recombination arm waveguides via a pair of recombination arm transformer steps, wherein the main waveguide, the junction waveguide, the pair of recombination arm waveguides and the pair of recombination arm transformer steps are manufacturable as a monolithic waveguide device that is configured to achieve symmetric dual spline mode suppression.

2. The device of claim 1, wherein the monolithic waveguide device comprises a linear waveguide orthomode transducer (OMT) device, and wherein the first port comprises a vertical polarization (VPOL) port of the OMT device.

3. The device of claim 2, wherein the main waveguide comprises a H-shaped cross-section at the first aperture supporting VPOL and horizontal polarization (HPOL) and a rectangular cross-section at a second aperture, and wherein the second aperture comprises an input port of the OMT device.

4. The device of claim 2, wherein the main waveguide comprises a H-shaped cross-section at the first aperture supporting VPOL and HPOL and a circular cross-section at a second aperture, wherein the spline taper comprises a hybrid spline taper configured to enable transition from the H-shaped cross-section to the circular cross section.

5. The device of claim 2, wherein the junction waveguide has an H-shaped cross-section aperture that matches an H-shaped cross-section of the first aperture of the main waveguide.

6. The device of claim 2, further comprising a HPOL port coupled through a stepped 90° transformer bend to a first output port of the junction waveguide, and wherein the OMT device is configured to transmit transverse-electric (TE)01 HPOL mode through the HPOL port and to suppress higher-order modes.

7. The device of claim 6, wherein the stepped 90° transformer bend comprises dual-purpose stepped E-plane bend that is configured to incorporate one section of a step transformer that enables profile reduction and direct machining with no undercuts to avoid sinker electrical discharge machining (EDM) operations.

8. The device of claim 6, wherein the junction waveguide further comprises a second output port and a third output port that are rectangular waveguides and are at about 90° with respect to a first output port of the junction waveguide.

9. The device of claim 8, wherein the junction waveguide is coupled to the pair of recombination arm waveguides at the second output port and the third output port.

10. The device of claim 8, wherein the first port comprises a VPOL port and the OMT device is configured to transmit TE10 VPOL mode through the VPOL port and to suppress higher-order modes.

11. The device of claim 1, wherein achieving symmetric dual spline mode suppression comprises suppressing modes launched due to asymmetries including path-length mismatch in excess of a predetermined tolerance.

12. The device of claim 1, wherein the pair of recombination arm waveguides comprise featureless planar reactive combiners that are configured to enable wire EDM.

13. An OMT device comprising:

a main waveguide having a H-shaped first aperture that transitions to a second aperture through a spline taper extending along an axis of the main waveguide;

a junction waveguide attached to the H-shaped first aperture of the main waveguide;

a pair of recombination arm waveguides attached to the junction waveguide; and a first port coupled to the pair of recombination arm waveguides via a pair of recombination arm transformer steps, wherein the OMT device is fabricated as a monolithic waveguide device and is configured to achieve symmetric dual spline mode suppression.

14. The OMT device of claim 13, wherein the second aperture has one of a rectangular or circular cross-section and forms an input port of the OMT device, and wherein the first port comprises a VPOL port of the OMT device and is configured to transmit TE10 VPOL mode through the VPOL port and suppress higher-order modes.

15. The OMT device of claim 13, wherein the junction waveguide includes an H-shaped cross-section aperture that matches the H-shaped first aperture of the main waveguide.

16. The OMT device of claim 13, wherein the junction waveguide further comprises a second output port and a third output port with rectangular apertures at about 90° with respect to a first output port of the junction waveguide.

17. The OMT device of claim 13, further comprising a HPOL port coupled through a stepped 90° transformer bend to a first output port of the junction waveguide, and wherein the HPOL port is configured to TE01 HPOL mode and to suppress higher-order modes, and wherein the stepped 90° transformer bend comprises dual-purpose stepped E-plane bend that is configured to incorporate one section of a step transformer that enables profile reduction and direct machining with no undercuts.

18. The OMT device of claim 13, wherein achieving symmetric dual spline mode suppression comprises suppressing modes launched due to asymmetries including path-length mismatch in excess of a predetermined tolerance, and wherein the pair of recombination arm waveguides comprise featureless planar reactive combiners that are configured to enable wire EDM.

19. A satellite communication system comprising:

a satellite antenna; and a polarization duplexer coupled to the satellite antenna, the polarization duplexer including a monolithic mode-whisperer, the monolithic mode-whisperer comprising:

a main waveguide having a spline taper extending along an axis of the main waveguide;

a junction waveguide attached to a first aperture of the main waveguide;

a pair of recombination arm waveguides attached to the junction waveguide; and a first port coupled to the pair of recombination arm waveguides via a pair of recombination arm transformer steps, wherein the monolithic mode-whisperer comprises a linear waveguide OMT device configured to suppress modes launched due to asymmetries.

20. The satellite communication system of claim 19, wherein the first port comprises a VPOL port of the monolithic mode-whisperer, wherein the monolithic mode-whisperer further comprises a HPOL port coupled through a stepped 90° transformer bend to a first output port of the junction waveguide, and wherein the monolithic mode-whisperer is configured to transmit TE01 HPOL mode through the HPOL port and TE10 VPOL mode through the VPOL port and to suppress higher-order modes.

* * * * *